US010094381B2

(12) United States Patent
Calhoun et al.

(10) Patent No.: US 10,094,381 B2
(45) Date of Patent: Oct. 9, 2018

(54) VACUUM PUMP SYSTEM WITH LIGHT GAS PUMPING AND LEAK DETECTION APPARATUS COMPRISING THE SAME

(71) Applicant: AGILENT TECHNOLOGIES, INC., Loveland, CO (US)

(72) Inventors: John Calhoun, Lexington, MA (US); Ronald J. Forni, Lexington, MA (US); Kevin Flynn, Tewksbury, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 532 days.

(21) Appl. No.: 14/732,637

(22) Filed: Jun. 5, 2015

(65) Prior Publication Data

US 2016/0356273 A1 Dec. 8, 2016

(51) Int. Cl.

| | |
|---|---|
| ***F04C 25/02*** | (2006.01) |
| ***F04C 18/02*** | (2006.01) |
| ***F04C 23/00*** | (2006.01) |
| ***F04C 28/02*** | (2006.01) |

(52) U.S. Cl.

CPC ..... *F04C 25/02* (2013.01); *F04C 18/0215* (2013.01); *F04C 18/0261* (2013.01); *F04C 23/005* (2013.01); *F04C 28/02* (2013.01)

(58) Field of Classification Search

CPC .... F04C 18/0215; F04C 23/005; F04C 25/02; F04C 28/02; F04C 18/0261; F04C 23/008

USPC ..... 418/180, 57; 417/251, 55.2, 310

See application file for complete search history.

(56) References Cited

U.S. PATENT DOCUMENTS

| | | | |
|---|---|---|---|
| 3,626,760 | A | 7/1969 | Briggs et al. |
| 3,690,151 | A | 9/1972 | Briggs |
| 3,824,839 | A | 7/1974 | Briggs |
| 3,968,675 | A | 7/1976 | Briggs |
| 4,499,752 | A | 2/1985 | Fruzzetti et al. |

(Continued)

FOREIGN PATENT DOCUMENTS

| | | | |
|---|---|---|---|
| EP | 0730093 | A1 | 9/1996 |
| EP | 1596066 | A1 | 11/2005 |

(Continued)

OTHER PUBLICATIONS

Huber, Marcia L, and Allan H Harvey. Thermal Conductivity of Gases. Jun. 6, 2011, www.nist.gov/publications/thermal-conductivity-gases.*

(Continued)

*Primary Examiner* — Devon Kramer
*Assistant Examiner* — Joseph Herrmann

(57) ABSTRACT

A rough vacuum pump system includes a primary vacuum pump and a secondary vacuum pump. The primary vacuum pump is an oil-free positive displacement pump, and has an inlet opening, an outlet opening, a compression stage between the inlet and outlet openings, and an intermediate gas passageway that connects to a gas flow path running through the compression stage. The secondary vacuum pump is connected to the intermediate gas passageway of the primary vacuum pump. The compression ratio of the primary and secondary vacuum pumps operating in combination is greater than that of the compression ratio of either of the primary and secondary vacuum pumps operating individually. A vacuum apparatus includes a tracer gas detector connected to an inlet of the primary vacuum pump.

17 Claims, 8 Drawing Sheets

(56) References Cited

U.S. PATENT DOCUMENTS 4,735,084 A 4/1988 Fruzzetti
4,845,360 A 7/1989 Landfors
5,210,413 A * 5/1993 Balzer ..... G01M 3/202 250/281
5,537,857 A 7/1996 Grosse Bley
5,542,828 A * 8/1996 Grenci ..... F04C 23/006 417/201
5,831,147 A 11/1998 Hoath
6,589,023 B2 * 7/2003 Royce ..... F04B 37/14 417/2
6,644,931 B2 * 11/2003 Puech ..... F04B 37/14 417/199.1
7,189,066 B2 * 3/2007 Liepert ..... F04C 23/001 418/201.1
7,254,989 B2 8/2007 Boehm et al.
7,537,440 B2 5/2009 Goodwin et al.
7,997,883 B2 * 8/2011 Ignatiev ..... F04C 18/0215 418/15
2004/0173312 A1 * 9/2004 Shibayama ..... F04C 23/001 156/345.29
2007/0160482 A1 * 7/2007 Inoue ..... F04B 41/06 417/206
2008/0080982 A1 * 4/2008 Tanigawa ..... F04C 18/126 417/46
2015/0086387 A1 3/2015 Tattersall

FOREIGN PATENT DOCUMENTS

JP 9015082 A 1/1997
WO 2015197395 A1 12/2015

OTHER PUBLICATIONS

UK Search Report dated Dec. 7, 2016 from related UK Application No. GB1609566.3.

* cited by examiner

VACUUM PUMP SYSTEM WITH LIGHT GAS PUMPING AND LEAK DETECTION APPARATUS COMPRISING THE SAME

BACKGROUND

Representative embodiments are directed to vacuum pump systems for evacuating enclosed chambers of devices or apparatus, such as processing chambers. Representative embodiments are also directed to leak detection apparatus including vacuum pump systems.

There are various industrial applications in which gases of low molecular weight, e.g., helium or hydrogen, must be pumped into or from an enclosed chamber. An example of such an application is gas chromatography in which helium or hydrogen used as a carrier gas for a sample analyte is pumped into a mass spectrometer. Another application is leak detection in which a gas of low molecular weight is provided in the ambient atmosphere around a chamber to be tested for leaks (test object), and gas in the chamber is pumped from the chamber and into a leak detection sensor capable of sensing the gas of low molecular weight. In these types of applications a vacuum pumping system is used to create a vacuum that draws gas from and/or induces gas into an enclosed chamber. One type of pump that is used in vacuum pumping systems for pumping gases, including those of low molecular weight, is a scroll vacuum pump.

A scroll pump includes a stationary plate scroll having a spiral stationary scroll blade, an orbiting plate scroll having a spiral orbiting scroll blade, and an eccentric driving mechanism to which the orbiting plate scroll is coupled. The stationary and orbiting scroll blades are nested with a radial clearance and predetermined relative angular positioning such that a series of pockets, constituting a compression stage of the pump, are simultaneously defined by and between the blades. The orbiting plate scroll and hence, the orbiting scroll blade, is driven by the eccentric driving mechanism to orbit relative to the stationary plate scroll about a longitudinal axis of the pump passing through the axial center of the stationary scroll blade. As a result, the volumes of the pockets delimited by the scroll blades of the pump are varied as the orbiting scroll blade moves relative to the stationary scroll blade. The orbiting motion of the orbiting scroll blade also causes the pockets to move within the pump head assembly such that the pockets are selectively placed in open communication with an inlet and outlet of the scroll pump.

In a vacuum scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. The inlet of the pump is connected to a system that is to be evacuated, e.g., a system including a processing chamber in which a vacuum is to be created and/or from which gas is to be discharged. Then the pocket is moved to a position at which it is sealed off from the inlet of the pump and is in open communication with the outlet of the pump, and at the same time the pocket is contracted. Thus, the fluid in the pocket is compressed and thereby discharged through the outlet of the pump.

In the vacuum pump systems applied to gas chromatography, leak detection, and the like, scroll pumps possess the advantage of not using oil, which could otherwise contaminate the instrumentation and result in false readings. Furthermore, in most applications an exhaust check valve is provided over the outlet of the vacuum scroll pump to prevent a reverse flow of gas during certain portions of the compression cycle, which would degrade the efficiency of the vacuum pump. However, as described above, a vacuum scroll pump relies on very small clearances between the blades of the orbiting and stationary scroll blades to maintain seals in between the pockets created between the inlet and outlet of the pump. Leakage through these clearances may occur during operation especially before enough pressure is created in the downstream pocket to open the exhaust check valve. These clearances are small enough that leakage at the seals is negligible when pumping air or gases of similar molecular weight, i.e., loss due to gas leakage is acceptable. On the other hand, the small molecules of gases of low molecular weight pass relatively easily through the small clearances between the stationary and orbiting scroll blades and move upstream in the pump. Accordingly, vacuum scroll pumps may not be very efficient, at pumping gases of low molecular weight, in terms of volumetric pumping speed or compression ratio.

Moreover, vacuum scroll pumps are often used to remove air from chambers where the air may contain water vapor as a result of humidity. In this case, the water vapor in the air being exhausted may condense as the gas is compressed. The solid lines in the graph of FIG. 1 show the compression process as air is moved from the inlet to the outlet of the pump. In this case, the discharge port is that portion of the outlet just upstream of the exhaust check valve as normally closed from the outside by the valve head of the check valve. If the amount of water vapor in the gas is relatively large, the saturation temperature of the gas being a function of both pressure and temperature, the saturation temperature will eventually exceed the actual gas temperature, at which point water will form as condensate of the gas between the blades of the scroll pump. This water can corrode components of the pump, and can absorb gases being pumped which can cause problems in the operation of the pump, etc.

To prevent condensation of gas inside a vacuum scroll pump, additional gas (air or dry nitrogen, for example) is directed into the compression stage through a gas passageway at a location near but not at the downstream end of the compression stage; this process being referred to as "gas ballast". The ballast gas dilutes the gas being worked by the vacuum scroll pump in the compression stage. The added gas load also increases the temperature of the gas. The combination of these two factors reduces saturation temperature of the gas stream below the actual gas temperature and condensation of water vapor is prevented. The changes to the patterns of internal pressure are shown by the chained lines in FIG. 1. It can be seen that now the saturation temperature line and the gas temperature line no longer intersect; thus, condensation of water will not occur. In addition, the use of gas ballast applies to the vapors of other substances which will take liquid form at the combinations of pressure and temperature that can exist within a vacuum pump, e.g., various organic solvents.

SUMMARY

Representative embodiments of a rough vacuum pump system include a primary oil-free positive displacement vacuum pump and a secondary vacuum pump, and the compression ratio of the primary and secondary vacuum pumps operating in combination is greater than that of the compression ratio of either of the primary and secondary vacuum pumps operating individually. The primary vacuum pump has an inlet opening, an outlet opening, a compression mechanism including a compression stage constituted by discrete pockets of compression that are sealed from each other and are interposed between the inlet opening and the outlet opening, and an intermediate gas passageway having first and second ends. The secondary vacuum pump has an inlet at which the secondary vacuum pump is connected to the primary vacuum pump at the first end of the intermediate gas passageway of the primary vacuum pump. The pockets constituting the compression stage of the primary vacuum pump include an inlet pocket at which fluid is taken into the compression stage, and an outlet pocket from which fluid is discharged from the compression stage. The second end of the gas passageway of the primary vacuum pump is directly connected to a gas flow path of the primary vacuum pump that starts at the inlet opening, runs through the compression stage and ends at the outlet opening. Accordingly, the secondary vacuum pump is operable to draw gas out of the compression stage of the primary vacuum pump at a location upstream of the outlet opening of the primary vacuum pump.

Representative embodiments of a rough vacuum pump system include a dry vacuum scroll pump having an exhaust check valve, and a secondary vacuum pump, and the compression ratio of the scroll and secondary vacuum pumps operating in combination is greater than that of the compression ratio of either of the scroll and secondary vacuum pumps operating individually. The dry vacuum scroll pump defines an inlet opening, an outlet opening, and an intermediate gas passageway having first and second ends, and comprises a stationary scroll blade, and an orbiting scroll blade nested with the stationary scroll blade so as to delimit therewith a series of pockets constituting a compression stage of the scroll pump. The secondary vacuum pump has an inlet at which the secondary vacuum pump is connected to the vacuum scroll pump at the first end of the intermediate gas passageway of the vacuum scroll pump. The second end of the gas passageway of the vacuum scroll pump is directly connected to a gas flow path of the vacuum scroll pump that starts at the inlet opening, runs through the compression stage and ends at the check valve. Accordingly, the secondary vacuum pump is operable to draw gas out of the compression stage of the vacuum scroll pump at a location upstream of the exhaust check valve.

Representative embodiments of a rough vacuum pump system include a dry vacuum scroll pump without an exhaust check valve, and a secondary vacuum pump, and the compression ratio of the scroll and secondary vacuum pumps operating in combination is greater than that of the compression ratio of either of the scroll and secondary vacuum pumps operating individually. The dry vacuum scroll pump defines an inlet opening, an outlet opening, and an intermediate gas passageway having first and second ends, and comprises a stationary scroll blade, and an orbiting scroll blade nested with the stationary scroll blade so as to delimit therewith a series of pockets constituting a compression stage of the scroll pump. The secondary vacuum pump has an inlet at which the secondary vacuum pump is connected to the vacuum scroll pump at the first end of the intermediate gas passageway of the vacuum scroll pump. The second end of the gas passageway of the vacuum scroll pump is directly connected to a gas flow path of the vacuum scroll pump that starts at the inlet opening, runs through the compression stage and ends at the outlet pocket. Accordingly, the secondary vacuum pump is operable to draw gas out of the compression stage of the vacuum scroll pump at a location upstream of the outlet pocket.

Representative embodiments of vacuum apparatuses include a tracer gas detector connected to the rough vacuum pump system at an inlet of the primary vacuum pump of the system.

DETAILED DESCRIPTION OF THE PREFERRED EMBODIMENTS

Figure 1:
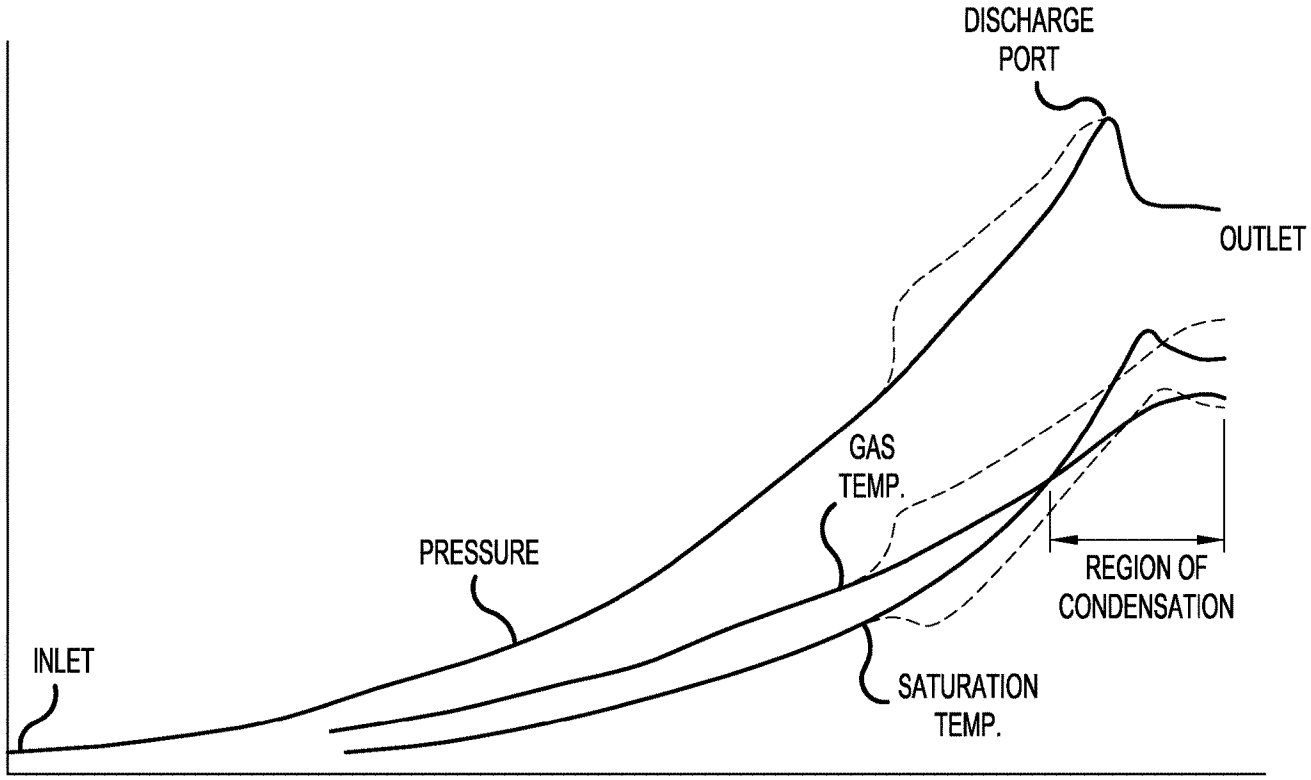
FIG.1 PRIOR ART
FIG. 1 is a graph of pressure, temperature and saturation temperature of gas as the gas is displaced from an inlet to an outlet of a conventional vacuum scroll pump including the use of ballast gas to prevent condensation from occurring in the pump.

Representative embodiments and examples of the embodiments will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, spatially relative terms are used to describe an element's relationship to another element(s) as illustrated in the figures. Thus, the spatially relative terms may apply to orientations in use which differ from the orientation depicted in the figures. Obviously, though, all such spatially relative terms refer to the orientation shown in the drawings for ease of description and are not necessarily limiting as apparatus according to the invention can assume orientations different than those illustrated in the drawings when in use.

Other terminology used herein for the purpose of describing particular examples or embodiments is to be taken in context. For example, the terms "comprises" or "comprising" when used in this specification indicates the presence of stated features but does not preclude the presence of additional features. The term "connected" may refer to a direct connection or a connection through the intermediary of one or more parts or component when not otherwise specified. The term "gas of low molecular weight" or "light gas" may refer to any gas whose density is less than that of air.

Figure 2A:
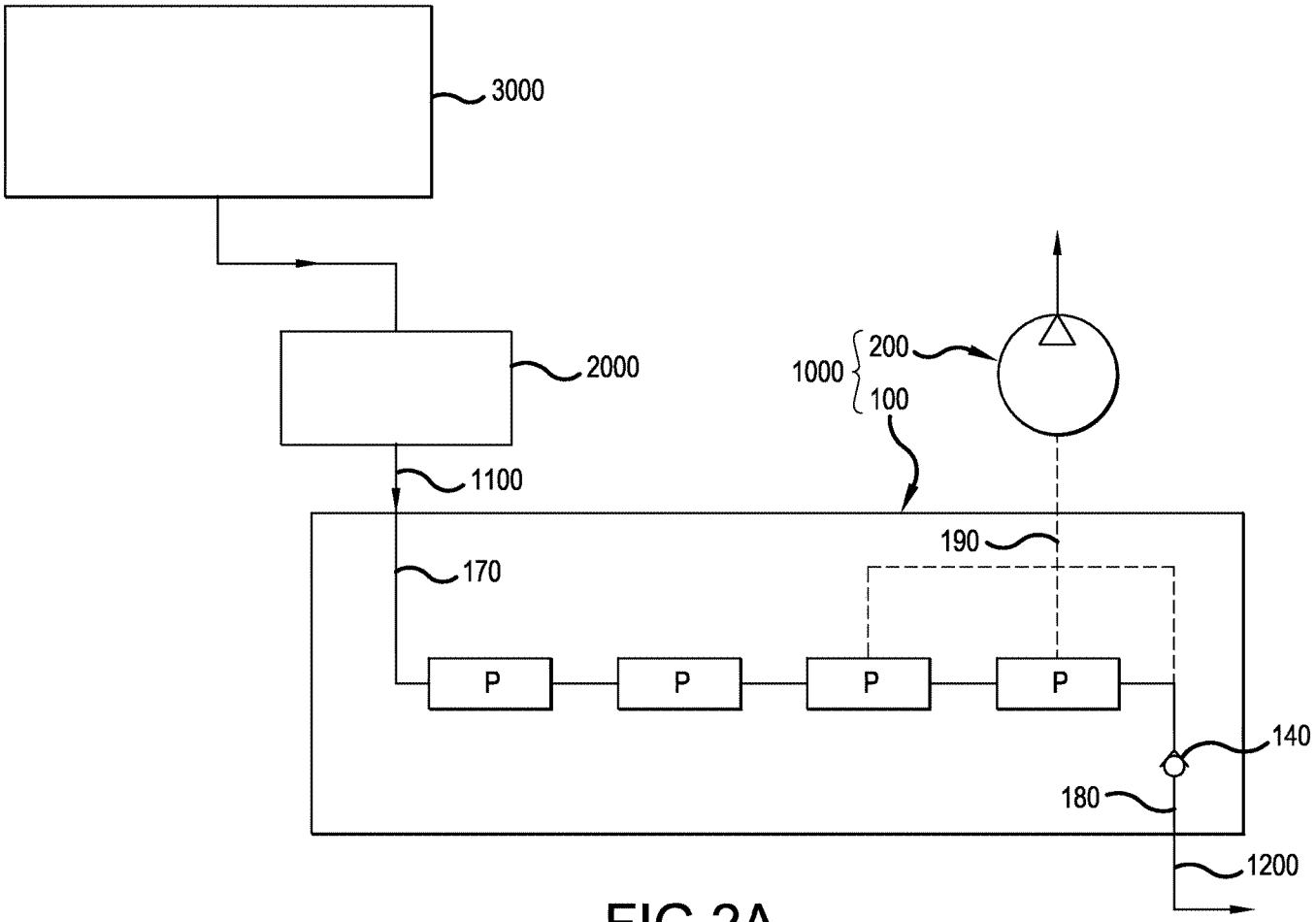
FIG. 2A is a block diagram of representative embodiments of vacuum apparatus.
Figure 2B:
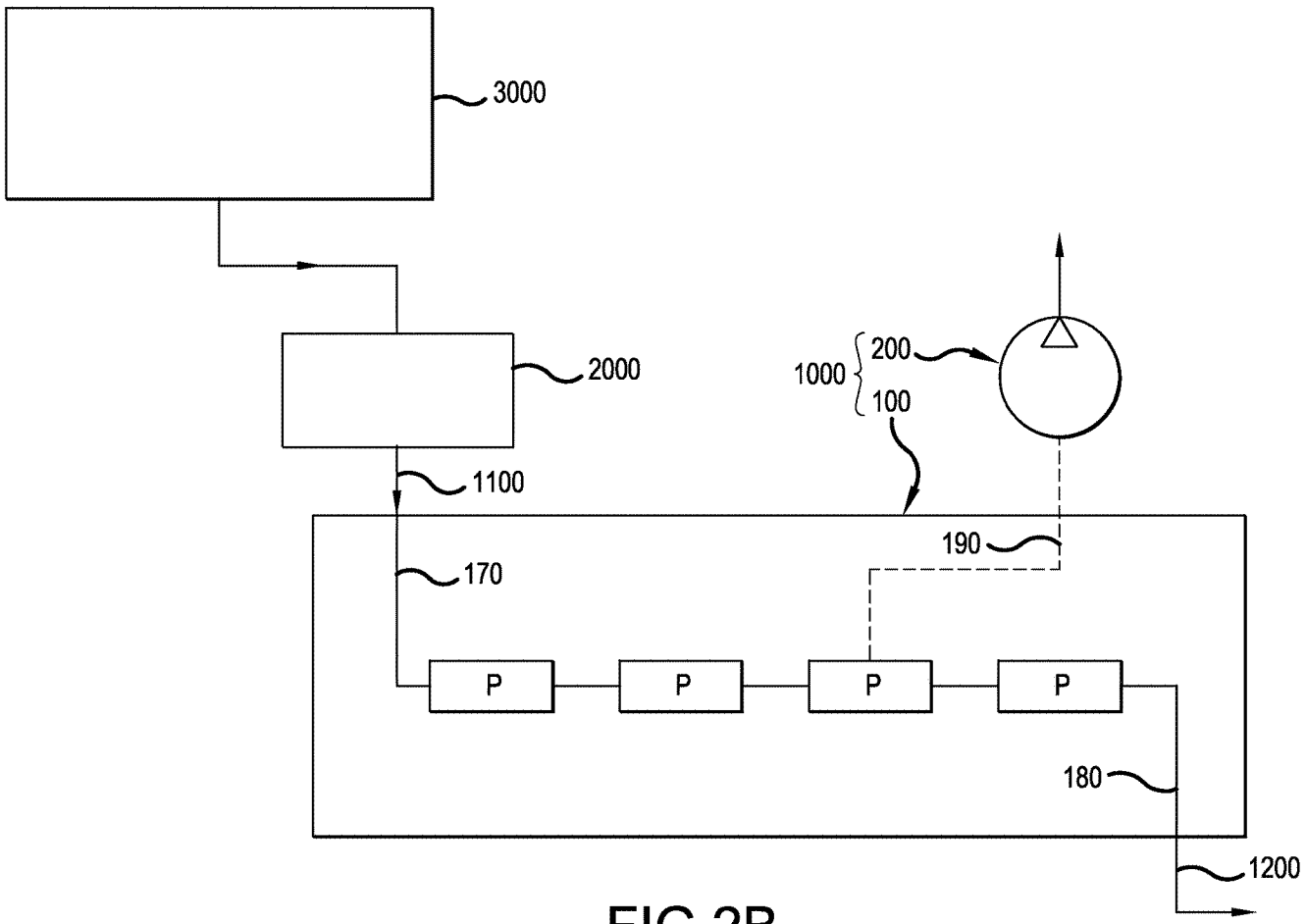
FIG. 2B is a block diagram of other representative embodiments of vacuum apparatus.

Referring first to FIGS. 2A and 2B, representative embodiments of a vacuum pump system 1000 generally includes a primary pump 100 and a secondary pump 200. Furthermore, the vacuum pump system 1000 may have an inlet 1100 at a vacuum side of the system where fluid is drawn into the pump system, and an outlet 1200 constituting a compression side of the system where fluid is discharged under pressure from the system. In representative embodiments of the vacuum pump system 1000, the primary pump 100 is an oil-free positive displacement pump such as a vacuum scroll pump, and the secondary pump 200 is also an oil-free positive displacement pump. For example, the secondary pump 200 is a scroll pump, a roots pump, a diaphragm or piston pump, a screw pump or a hook and claw pump.

The vacuum pump system 1000 can be connected, via its inlet 1100, to a system or device 2000 in which a vacuum is to be created and/or from which gas is to be discharged. The system or device 2000 may comprise one or more chambers and one or more turbomolecular pumps. In a representative embodiment of vacuum apparatus that includes the vacuum pump system 1000, the device 2000 is a detector for detecting a tracer gas of a low molecular weight, and the vacuum pump system 1000 draws gas comprising the tracer gas into the detector. For example, the detector constituting device 2000 is a leak detector. In this case, the leak detector 200 may be connected to an appliance 3000 with the leak detector 2000 interposed between the appliance 3000 and the primary vacuum pump 100 of the vacuum pump system 1000. The appliance 3000 may be a test object to be detected for leaks (e.g., a chamber of some device or system) or a device for use in checking a test object for leaks as will be described in more detail later on with reference to FIG. 9.

As will also be described in more detail in connection with examples of the vacuum pump system 1000, the primary vacuum pump 100 is an oil-free positive displacement pump having an inlet opening 170 and an outlet opening 180, and includes a compression mechanism that draws gas into the primary vacuum pump 100 at the inlet opening 170 and force the gas out of the primary vacuum pump 100 through the outlet opening 180. The compression mechanism has a compression stage providing discrete pockets P of compression, i.e., pockets P that are sealed from each other and are contracted to compress the gas therein. FIGS. 2A and 2B show an example of a compression mechanism having a single compression stage in which the pockets of compression P are each sequentially placed in communication with the inlet opening 170 and the outlet opening 180. However, the compression mechanism could have multiple stages connected in series, in which case the compression stage of representative embodiments would be the last compression stage in the series with respect to the direction of gas flow. Thus, each pocket P of the compression stage is placed in communication with the outlet opening 180. Prior to and/or at this time, the pocket P may be contracted to compress the gas and thereby discharge the gas through the outlet opening 180.

In the representative embodiments shown in FIG. 2A, the primary vacuum pump 100 also has an exhaust check valve 140 that normally closes the compression stage to the outlet opening 180. FIG. 2B shows representative embodiments in which there is no exhaust check valve over the outlet opening 180. Furthermore, in either case, the vacuum pump system 1000 includes a gas passageway 190 that connects the secondary pump 200 directly to a primary path of gas flow of the scroll pump 100 that starts at the inlet opening 170, runs through the compression stage and ends at the last location sealed from the outlet opening 180 (the check valve 140 in the embodiments of FIG. 2A or the penultimate pocket P in the direction of gas flow in the embodiments of FIG. 2B). In the embodiments of FIG. 2A, the gas flow passageway 190 may be connected directly to the primary path of gas flow at any of various locations (exemplified by the dashed lines in the figure) upstream of the exhaust check valve 140. On the other hand, in the embodiment of FIG. 2B, the gas flow passageway may be connected directly to the primary gas flow path at the penultimate pocket or upstream thereof.

In representative embodiments, the compression ratio of the primary and secondary vacuum pumps 100 and 200 operating in combination, i.e., the compression ratio of the vacuum pump system 1000, is greater than the compression ratio of the primary vacuum pump 100 alone and is also greater than the compression ratio of the secondary vacuum pump 200 alone. Here, as is known in the art, the compression ratio is the ratio of the pressure (usually atmospheric) at the outlet to the inlet pressure. When the pressure in inlet 1100 is relatively high, as when evacuating test object 3000, the gas flow opens and passes through the exhaust check valve 140 of the primary vacuum pump and exits to the ambient atmosphere around the system. The conductance of the secondary pump 200 does not affect the efficiency of primary pump 100. On the other hand, when the pressure in inlet 1100 is relatively low, as when appliance 3000 has been substantially pumped out or is free of tracer gas, the secondary pump 200 may be operated to reduce the pressure in gas passageway 190 below atmospheric pressure so the exhaust valve 140 will remain closed. Thus, in an example in which the system or device 2000 is a leak detector that can detect a tracer gas, the tracer gas cannot enter the leak detector 2000. Because the gas passageway 190 is connected to the compression stage at a location near the end of the compression process, substantially the same performance increase in pumping tracer gas is achieved as if the secondary pump 200 were connected to the primary vacuum pump outlet opening 180.

Figure 3:
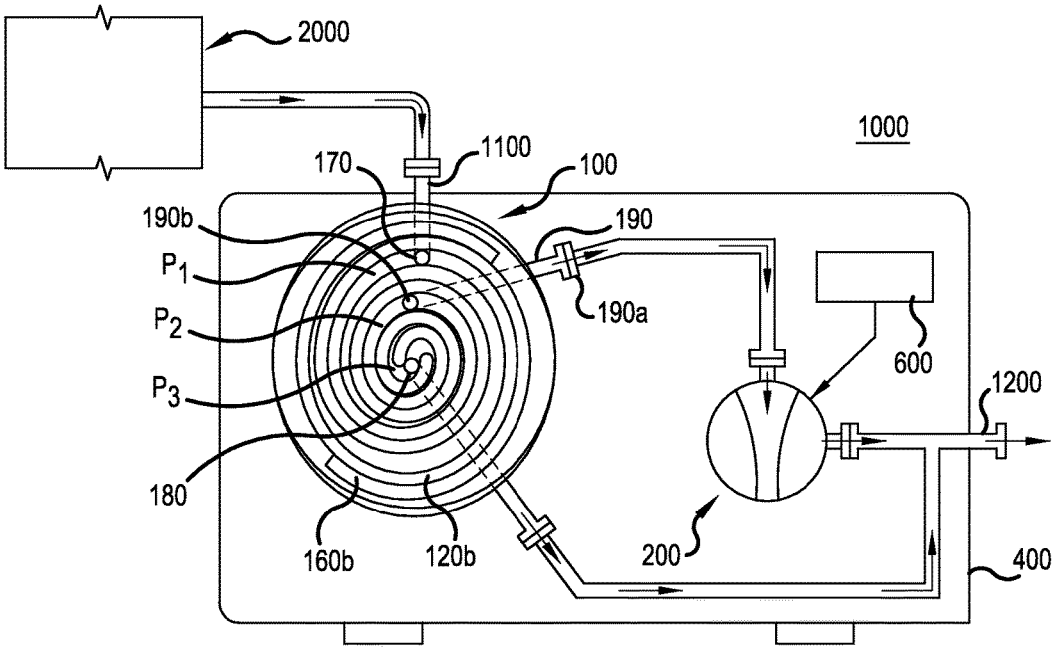
FIG. 3 is a schematic diagram illustrating a representative embodiment of a vacuum pump system.
Figure 4:
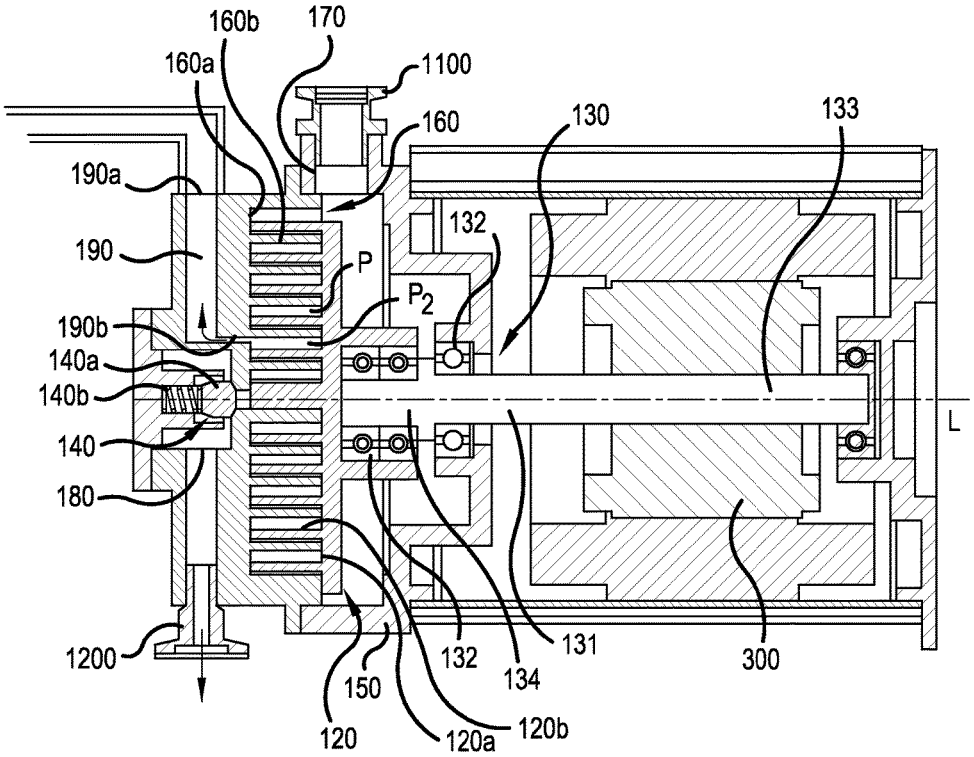
FIG. 4 is a longitudinal sectional view of a vacuum scroll pump of the system shown in FIG. 3.

A representative embodiment of a vacuum apparatus comprising pump system 1000 is shown in FIGS. 3 and 4. In FIG. 3, some elements may be omitted for clarity.

The primary oil-free positive displacement vacuum pump 100 of this embodiment is a vacuum scroll pump. Also, although the scroll pump 100 is shown as having an exhaust check valve 140, i.e., is an example of the primary vacuum pump shown in FIG. 2A, the valve may be omitted or removed as in the representative embodiments illustrated by FIG. 2B. In either case, the scroll pump 100 includes an orbiting plate scroll 120, an eccentric drive mechanism 130, frame 150, stationary plate scroll 160 and a motor 300 for driving the eccentric drive mechanism 130. Reference numeral 400 designates a cowling 400 in which the scroll pump 100 and secondary pump 200 may be housed together.

The stationary plate scroll 160 is fixed to the frame 150. The frame 150 also supports the eccentric drive mechanism 130. The orbiting plate scroll 120, eccentric drive mechanism 130, and exhaust check valve 140 may thus be integrated in a pump head assembly by means of the frame 150. The exhaust check valve 140 may comprise a valve head 140*a*, and spring 140*b* biasing the valve head 140*a* to a normally closed position. The frame 150 may be of one piece, i.e., may be unitary, or may comprise several integral parts that are fixed to one another.

The frame 150 may also define the inlet opening 170 to which the pump inlet 1100 extends. The frame 150 or the stationary plate scroll 160 (as in the illustrated example) defines the exhaust opening 180 leading to the pump outlet 1200, and the gas passageway 190. The gas passageway 190 has a first end 190*a* (port) leading to the outside of the pump system, e.g., to the pump outlet 1200, and a second end (port) 190*b* at which the gas passageway 190 is directly connected to the primary path of gas flow of the scroll pump 100. Furthermore, the gas passageway 190 may be the same passageway as that used to provide ballast gas in a conventional scroll pump.

The stationary plate scroll 160 comprises a floor (or stationary plate) 160*a* and a stationary scroll blade 160*b* projecting axially from the floor 160*a*. The orbiting plate scroll 120 comprises a floor (orbiting plate) 120*a* and an orbiting scroll blade 120*b* projecting axially from the floor 120*a*. The orbiting scroll blade 120*b* and the stationary scroll blade 160*b* are nested with a clearance and predetermined relative angular positioning such that the series of pockets P, constituting the aforementioned compression stage, are simultaneously formed by and between the orbiting and stationary scroll blades 120*b*, 160*b*.

In representative embodiments in which the scroll pump 100 is oil-free or what is referred to as a "dry" scroll pump and as is known, per se, the scroll pump is configured so that that blades 120*b*, 160*b* do not contact each other. If the blades 120*b*, 160*b* were to otherwise contact to each other to any great extent, the blades and the pump could be damaged. In light of this, minute radial clearances between portions of the scroll blades 120*b*, 160*b* create seals sufficient for forming satisfactory pockets P delineated from one another. In addition, the scroll pump 100 may have a tip seal (not shown) to create an axial seal between the scroll blade of one of the orbiting and stationary plate scrolls and the floor or plate of the other of the orbiting and stationary plate scrolls. The tip seal may be a plastic member seated in a groove in and running the length of the tip of the scroll blade of one of the stationary and orbiting plate scrolls so as to be interposed between the tip of the scroll blade and the floor or plate of the other of the stationary and orbiting plate scrolls. Such tip seals are known per se and accordingly, will not be described here in further detail.

As best shown in FIG. 4, the eccentric drive mechanism 130 may take any form of those employed by scroll pumps and thus, may include a crank shaft 131 and bearings 132. In this example, the crank shaft 131 has a main portion 133 coupled to the motor 300 so as to be rotated by the motor about the longitudinal axis L of the scroll pump 100, and a crank 134 whose central longitudinal axis is offset in a radial direction from the longitudinal axis L. Also, in this example, the main portion 133 of the crank shaft is supported by the frame 150 via one or more sets of the bearings 132 so as to be rotatable relative to the frame 150. The orbiting plate scroll 120 is mounted to the crank 134 via another set or sets of the bearings 132. Thus, the orbiting plate scroll 120 is carried by crank 134 so as to orbit about the longitudinal axis of the scroll pump when the main portion 133 of the crankshaft is rotated by the motor 300, and the orbiting plate scroll 120 is supported by the crank 134 so as to be rotatable about the central longitudinal axis of the crank 134.

During a normal operation of the pump, loads on the orbiting scroll blade 120*b* tend to cause the orbiting plate scroll 120 to rotate about the central longitudinal axis of the crank 134. Therefore, a mechanism (not shown) such as an Oldham coupling or metallic bellows may be provided for restraining the orbiting plate scroll 120 in such a way as to allow it to orbit about the longitudinal axis L of the scroll pump while inhibiting its rotation about the central longitudinal axis of the crank 134.

The orbiting motion of the orbiting scroll blade 120*b* relative to the stationary scroll blade 160*b* causes a pocket P open to the inlet opening 170 to expand. Accordingly, gas is drawn into the pocket inlet P through the inlet opening 170. Then the pocket P is moved to a position at which it is sealed off from the inlet opening 170 and the exhaust opening 180 by the small radial clearances between the nested scroll blades 120*b*, 160*b*. Finally, the pocket P is moved to a position at which it is in open communication with the outlet opening 180, and at the same time the pocket P is contracted. Thus, the gas in the pocket P is compressed and once the gas reaches a certain discharge pressure, the gas opens the exhaust check valve 140 and is discharged from the scroll pump 100 and pumping system through the exhaust opening 180 and outlet 1200.

Figure 5:
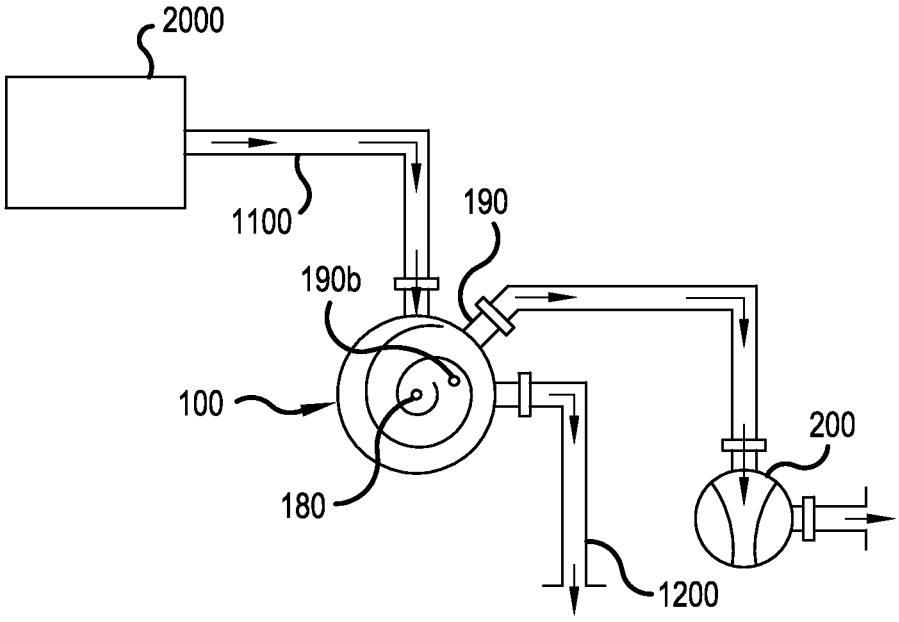
FIG. 5 is a schematic diagram illustrating another representative embodiment of a vacuum pump system.

FIG. 3 shows an example in which the outlet of the secondary vacuum pump 200 is tied to the outlet of the primary pump 100. FIG. 5 shows an example in which the outlet of the secondary vacuum pump 200 is vented separately from the outlet opening 180 of the scroll pump and outlet 1200.

Referring back to FIGS. 2A, 2B and 3, at any point in time, therefore, the series of pockets P constituting the compression stage of the scroll pump 100 include an inlet pocket $P_1$ at which fluid is being taken into the compression stage, an outlet pocket $P_3$ from which fluid is being discharged from the compression stage, and at least one intermediate pocket $P_2$ between the inlet and outlet pockets $P_1$, $P_3$ with respect to the direction of flow of gas from inlet opening 170 to exhaust opening 180 through the compression stage. That is, the inlet pocket $P_1$ is the pocket open to the inlet opening 170, the outlet pocket $P_3$ is the pocket open to the exhaust opening 180 and the intermediate pocket(s) $P_2$ is/are sealed from the inlet opening 170 and exhaust opening 180.

In an example of the representative embodiment, the compression stage is formed by the inlet pocket $P_1$, the outlet pocket $P_3$ and a plurality of intermediate pockets $P_2$ provided in series between the inlet and outlet pockets P and $P_3$.

With reference to FIGS. 2A, 3 and 4, i.e., in examples in which the scroll pump 100 has exhaust check valve 140 (and again, as exemplified by the dashed lines in FIG. 2A): (1) the gas passageway 190 may be directly connected to the gas flow path at a location between the exhaust check valve 140 and the outlet pocket $P_3$, and (2) the gas passageway 190 may be alternatively or additionally directly connected to one or more of the pockets P. In examples of the representative embodiment in which the gas passageway 190 is directly connected to one or more of the pockets P, the gas passageway 190 is preferably directly connected to only one or more of the pockets P that is/are located closer to the outlet opening 180 than the inlet opening 170 with respect to the direction of flow of gas through the compression stage.

On the other hand, with reference to FIGS. 2B, 3, i.e., in examples in which the exhaust check valve 140 is not provided in the scroll pump 100, and as shown by the dashed lines in FIG. 2B, the gas passageway 190 must be directly connected to a pocket(s) P that is upstream of the outlet pocket $P_3$ with respect to the flow of gas through the scroll pump 100 from inlet opening 170 to outlet opening 180. That way, the outlet pocket $P_3$ seals the inlet of the secondary pump 200 from the outlet opening 180 of the vacuum scroll pump 100.

As concerns these examples, vacuum scroll pumps rely on the aforementioned small internal clearances and numbers of turns (also referred to as "wraps") of the spiral scroll blades to generate the compression required to meet the ultimate pressure requirements of the pump.

Especially in the case in which the scroll pump is operating while meeting its ultimate pressure requirements, the inlet side of the scroll pump is at a low pressure, and the exhaust side of the pump is at a relatively high pressure. The pressure differential from exhaust side to the inlet side creates a potential for leakage of the gas in the pump in a direction from the exhaust side to the inlet side through the internal clearances between the plate scrolls. Furthermore, this potential for leakage is increased as the tip seal(s) between the plate scrolls begin to wear. In any case, such a backflow of the gas may not only affect the performance of the pump but may, in turn, upset the operation of the device or system connected to the scroll pump.

The secondary pump 200 can mitigate this potential problem by evacuating residual gas from the compression stage at a location(s) immediately upstream of the exhaust check valve 140. This and other advantages will be explained in more detail below with respect to other representative embodiments and examples thereof.

Figure 6:
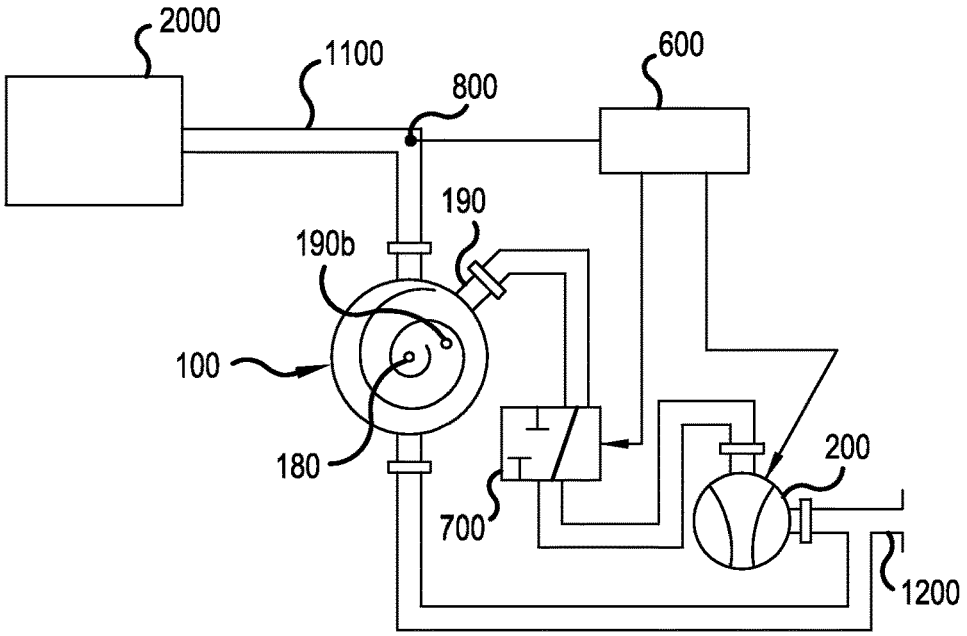
FIG. 6 is a schematic diagram showing another representative embodiment of a vacuum pump system.

FIGS. 6 and 7 illustrate representative embodiments in which the vacuum pump system 1000 includes a directional flow control valve disposed in-line between the gas passageway 190 and the secondary vacuum pump 200.

In the embodiment of FIG. 6, the directional flow control valve is a two position directional flow control valve 700 that is movable between a first position at which the valve allows the flow of gas to the secondary vacuum pump 200 from the primary vacuum pump 100 via the intermediate gas passageway 190, and a second position at which the valve blocks the flow of gas to the secondary vacuum pump 200 from the primary vacuum pump 100 via the intermediate gas passageway 190.

The vacuum pump system or apparatus comprising the same may also include a control system including a controller 600 operatively connected to the secondary vacuum pump 200 and to the valve 700 and a pressure sensor 800 positioned in the inlet 1100 to sense the pressure in the pump inlet 1100.

When pressures in the inlet 1100 is relatively high as sensed by pressure sensor 800, during an operation in which the device or system 2000 is being evacuated, the controller 600 closes the valve 700 (moves the valve to the second position) such that gas can not pass from the gas passageway 190 to the secondary pump 200. The secondary pump 200 is thus prevented from experiencing excessive pressure at its inlet. Also, the secondary pump 200 may be turned off at this time by the controller 600 to extend its life. The valve 700 is moved to or maintained at its first position by the controller 600 when pressure of the gas in inlet 1100 is relatively low, such as may occur when device or system 2000 has been substantially pumped out. In this case, the valve allows for fluid communication between the gas passageway of primary vacuum pump 100 and the secondary pump 200. In this operating condition, therefore, an improvement of compression in pumping helium or other low molecular weight gas is achieved, while at the same time there is no restriction to pumping out device or system 2000. In addition, this operating condition may be provided despite the presence of the exhaust check valve 140 in the system. Accordingly, the system can enjoy the known noise reduction benefits provided by the exhaust check valve 140.

Figure 7A:
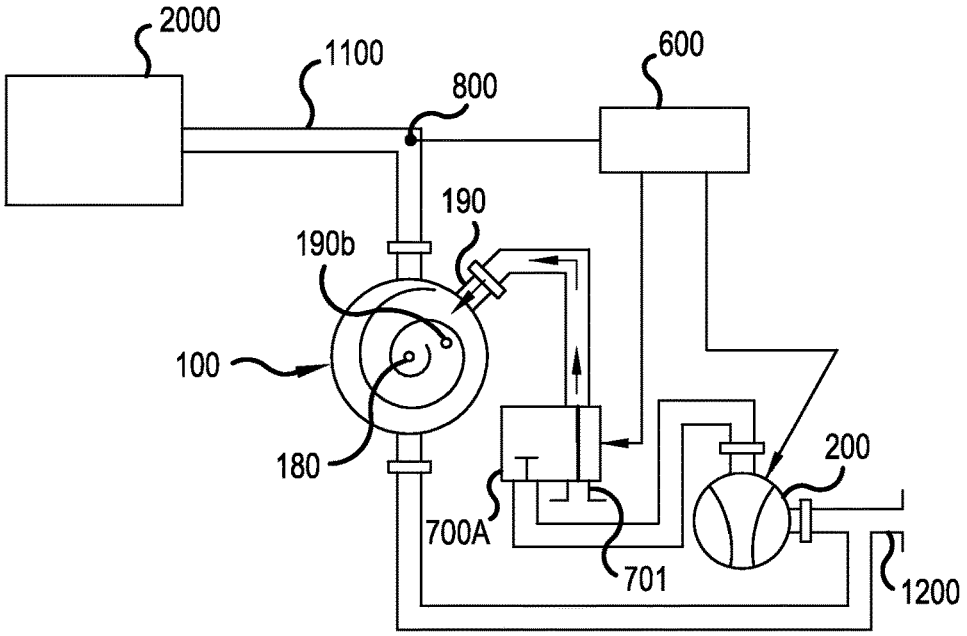
FIGS. 7A and 7B are schematic diagrams showing still another representative embodiment of a vacuum pump system.
Figure 7B:
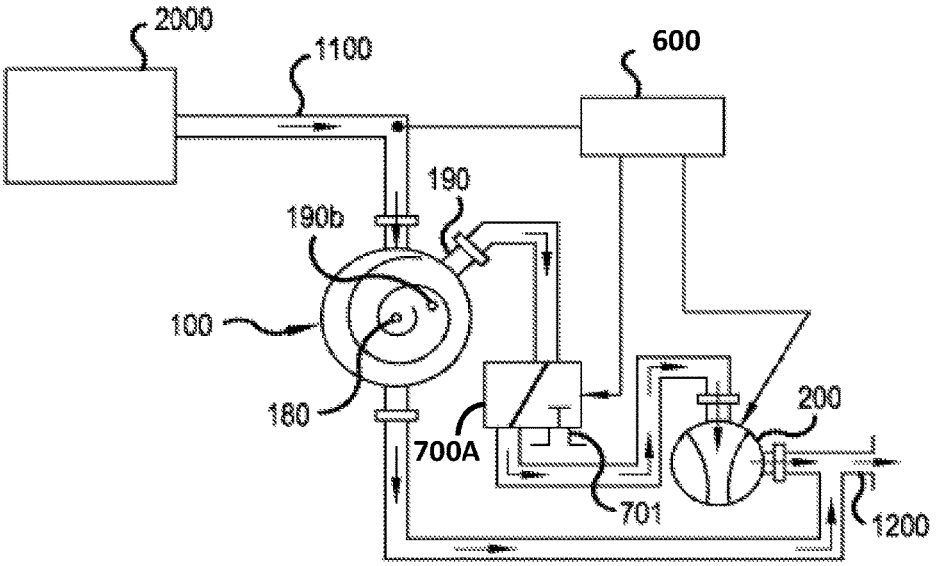

In the embodiment of FIGS. 7A and 7B, the vacuum pump system or apparatus comprising the same includes a multi-port directional flow control valve 700A whose position is also controlled by a control system including a controller 600 and pressure sensor 800. This control valve 700A establishes two operating conditions.

The first condition, as shown in FIG. 7A, is established when the pressure inlet 1100 is relatively high, as when pumping gas out of device or system 2000. In this condition, the secondary pump 200 is valved out of the gas stream by the action of the control valve 700A. The secondary pump 200 may be turned off in this condition to extend its life. Air or another suitable gas for gas ballast is drawn into port 701 of the control valve 700A, passing through the valve and into gas passageway of primary vacuum pump 100. In this way condensation is prevented from occurring inside primary vacuum (scroll) pump 100. The exhaust stream, consisting of gas from system or device 2000 and ballast gas from passageway 190, is exhausted through the outlet 1200 of the vacuum pump system to atmosphere.

The second condition, as shown in FIG. 7B, is established when pressure in the inlet 1100 is relatively low, as when device or system 2000 has been substantially pumped out. In this case, the state of valve 700A is reversed thus placing the gas passageway 190 of the primary vacuum (scroll) pump 100 and the secondary pump 60 in fluid communication. In this operating condition, therefore, the improvement of compression in pumping helium or other low molecular weight is achieved.

Although the control system has been shown and described as having a pressure sensor located in the inlet 1100 of the vacuum pump system, the pressure sensor could be located in other places such as at the outlet of the system or device 2000. Also, the directional flow control valves 700, 700A may be solenoid operated valves and controlled by electrical signals from the controller 600. Alternatively, the directional flow control valves 700, 700A could be pressure-actuated valves. Still further, although the control system has been shown as having only one pressure sensor 800, a plurality of pressure sensors could be provided at various locations in the vacuum pump system or apparatus comprising the same, and the pressures from these sensors could be used to position the directional flow control valve. For instance, in another example of the representative embodiment of FIGS. 7A and 7B, the controller 600 is configured such that the directional flow control valve 700A is positioned based on a relationship among pressures sensed by pressure sensors located in or near the gas inlet 1100, gas passageway 190, inlet of the secondary pump 200 and the pressure of the ambient atmosphere. In addition, the operation of the control valve, and the turning on and off of the secondary pump, may be controlled based on a variety of other process parameters in the operation of the vacuum system 1000 or in an apparatus employing the vacuum system 1000 such as a leak detection apparatus, as will be readily appreciated by those skilled in the art.

Figure 8:
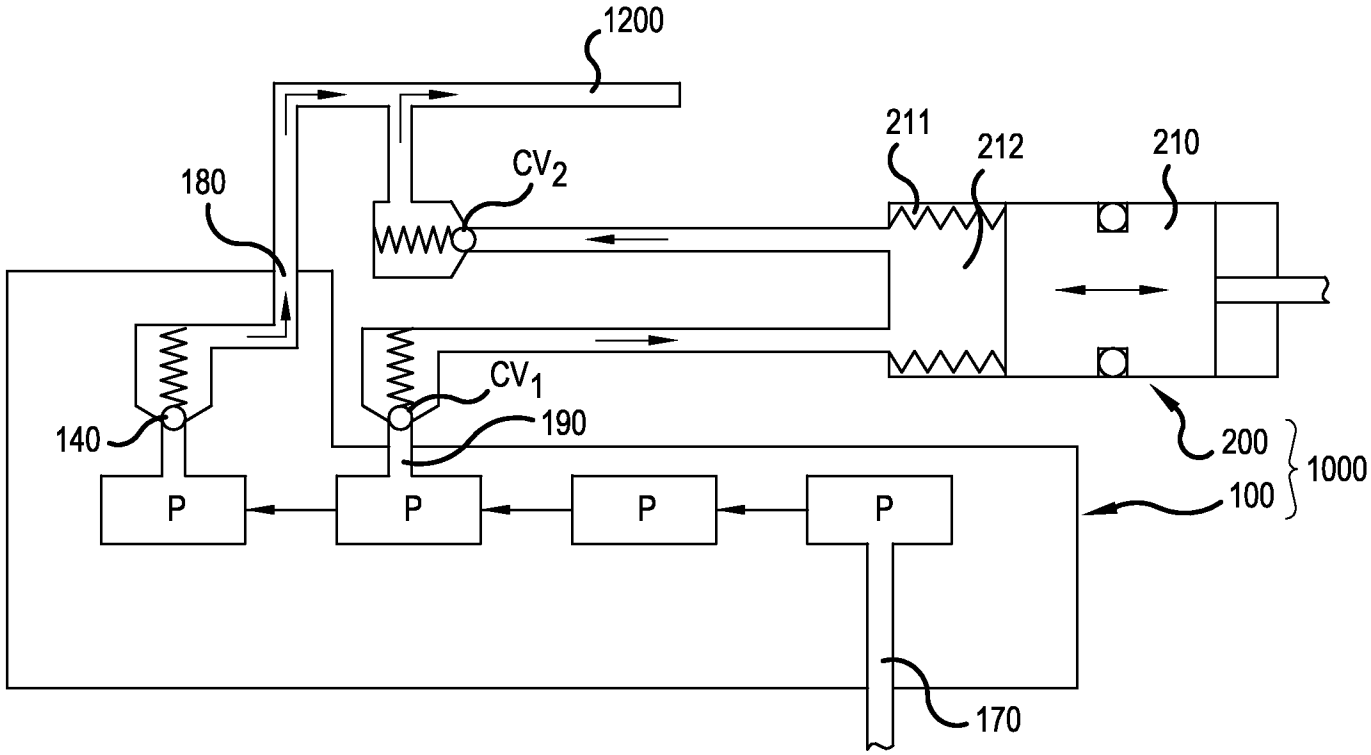
FIG. 8 is a block diagram of another representative embodiment of a vacuum pump system.

FIG. 8 illustrates another representative embodiment of a vacuum pump system 1000. In this embodiment, the secondary pump 200 is a piston type of pump comprising a piston 210. A first system check valve $CV_1$ is provided in the intermediate gas passageway 190, i.e., between the compression stage of the vacuum scroll pump 100 and the secondary pump 200. A second system check valve $CV_2$ is provided between the outlet of the secondary pump 200 and the ambient atmosphere outside the system 100. In this example in which the outlet of the secondary pump 200 is tied to the outlet of the vacuum scroll pump 100, the second system check valve $CV_2$ is provided between the outlet of the secondary pump 200 and the outlet 1200 of the vacuum pump system. A bellows 211 may be provided in lieu of or in addition to a piston ring of the piston 210 to form a sealed pump chamber 212 of the secondary pump 200.

In operation, the piston 210 is reciprocated in directions denoted by the double-headed arrow so as to have an intake stroke (piston movement to the right in the figure) and a discharge stroke (piston movement to the left). During the intake stroke of the piston 210, negative pressure is created in the chamber 212 to open the system check valve $CV_1$, and draw gas into the chamber 212 of the secondary pump 200 via the gas passageway 190. That is, gas is drawn out of the compression stage of the vacuum scroll pump 100 at a location just upstream of the exhaust check valve 140 of the pump. During the discharge stroke of the piston 210, the gas in chamber 212 is compressed to open the second system check valve $CV_2$ whereby the gas is discharged from the system. At this time, the first system check valve $CV_1$ prevents a backflow of gas into the compression stage of the vacuum scroll pump 100.

Note, also, that when a piston type of secondary vacuum pump 200 is used, the piston 210 as a secondary pumping mechanism may be integrated with the primary vacuum pump 100. For example, in the case in which the primary vacuum pump is a vacuum scroll pump of the type shown in FIG. 4 and has an exhaust check valve, the piston 210 may be provided within the intermediate gas passageway 190. In this case, various types of actuators could be used to reciprocate the piston 210 within the gas passageway 190. Also, in this case, the secondary vacuum pump would have an intake stroke at which the piston 210 would be driven towards the first end 190*a* of the intermediate gas passageway 190 to draw gas in at a location(s) upstream of the exhaust check valve 140, and a discharges stroke at which the piston 210 would be driven towards the second end 190*b* of the intermediate gas passageway 190 to expel gas out the outlet opening 180 by opening the exhaust check valve 140.

Also, as is clear from FIGS. 2A and 2B, the features of the representative embodiments and examples thereof shown in and described with reference to FIGS. 3-8 may be employed by various types of apparatus having a tracer gas detector.

Figure 9:
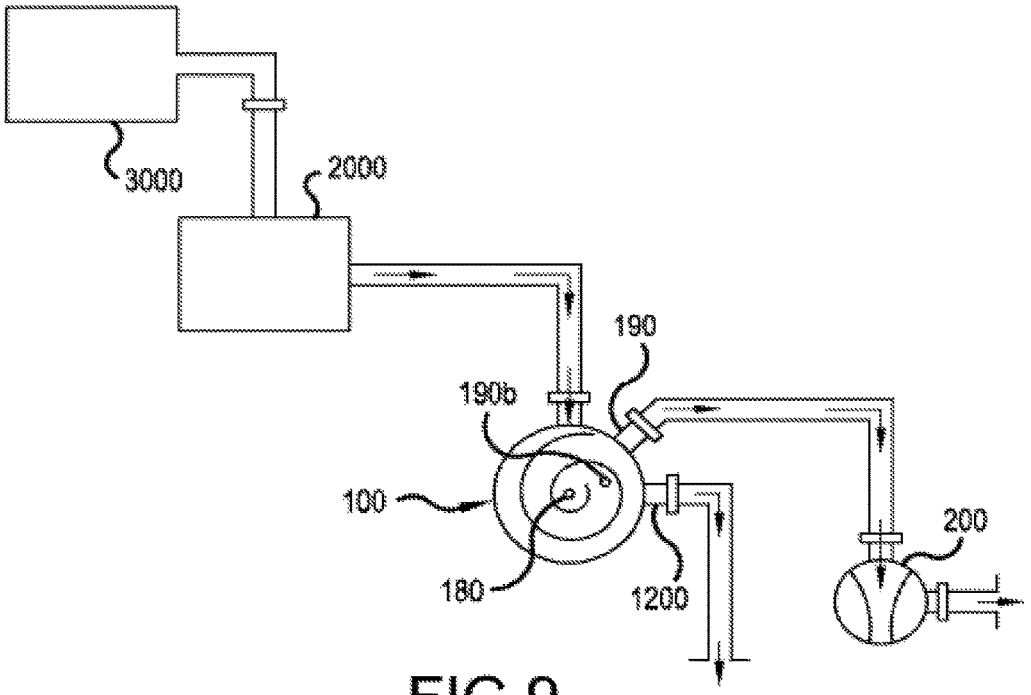
FIG. 9 is a schematic diagram of a representative embodiment of a vacuum apparatus.

FIG. 9 illustrates an example of such vacuum apparatus. In this example, device 2000 is a leak detector capable of detecting a light (tracer) gas. For instance, leak detector 2000 may comprise a mass spectrometer, Penning cell, magnetron, or gas-consuming vacuum gauge, and support equipment and controls therefor. The leak detector 2000 is interconnected between the vacuum pump system 1000 and appliance 3000. Appliance 3000 may be a chamber to be tested for leaks (test object). In this case, the light tracer gas may be provided around the chamber 3000 and the chamber is evacuated by the vacuum pump system 1000 via the leak detector 2000. The compression ratio of the primary and secondary vacuum pumps 100 and 200 operating in combination when pumping the light gas is greater than that of the compression ratio of either of the primary and secondary vacuum pumps pumping the light gas alone. If the chamber 3000 has a leak, the light gas is drawn into the chamber 3000 by the vacuum created therein by the vacuum pump system 1000, and the light gas along with the gas in the chamber 3000 is drawn by the system 1000 through the leak detector 2000 whereby the light gas is detected by the detector.

The chamber 3000 does not have to constitute the test object. For example, the test object could be some object pressurized with the tracer gas, and placed in the chamber 3000. Alternatively, the interior of a test object could be connected to the leak detector 200, the test object could be place in chamber 3000 and the chamber 3000 could be filled with tracer gas. In either case, if the test object in chamber 3000 has a leak, the light tracer gas is drawn by the system 1000 through the leak detector 2000 whereby the light gas is detected by the detector.

In still another example, appliance 3000 could be a so-called "sniffer" consisting of a wand containing a tiny orifice or semi-permeable membrane, and connected to the leak detector 2000. In this case, the test object could be pressurized with the tracer gas, and the outside of the object could be scanned (for example, long its seams) with the "sniffer". Any gas leaking from (the seams of) the test object is drawn by the system 1000 into the wand through orifice or semi-permeable membrane and from the wand into the leak detector 2000, whereby the tracer gas is detected by the detector.

A representative embodiment of a vacuum pump system, or vacuum apparatus including a tracer gas detector and a vacuum system as described above may provide one or more of the following benefits:

(1) a dramatic reduction in the base pressure of the scroll pump of a vacuum pumping system as a result of the reduced pressure upstream of the exhaust check valve which, in turn, results in a corresponding reduction in the leakage of the gas back to the pump inlet;

(2) a reduction in the amount of work needed to compress the gas in the compression stage resulting in a substantial reduction in power draw of the primary vacuum pump at base pressure conditions;

(3) lower temperature and increased life of the primary pump, such as the lower temperature of the pump head and increased life of the bearings/grease of a scroll pump, at base pressure conditions as a result of the reduced power draw of the primary vacuum pump:

(4) increase in the life of the tip seal(s) of a vacuum scroll pump as a result of eliminating the gas actuating pressure which acts to wear away the tip seal near the axial center of the scroll pump;

(5) reducing the amount of condensation of the gas in the compression stage; and (6) increased life of the secondary vacuum pump by allowing the pump to be turned off during certain operating conditions.

Finally, embodiments of the inventive concept and examples thereof have been described above in detail. The inventive concept may, however, be embodied in many different forms and should not be construed as being limited to the embodiments described above. For example, although the present invention has been described in detail with respect to vacuum scroll pumps, the present invention may be applied to other types of vacuum pumps that have at least one compression stage constituted by regions of compression, i.e., sealed "pockets", whose volume is varied to draw fluid into the pump and expel the fluid from the pump. Accordingly, the embodiments and examples of the invention were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A rough vacuum pump system comprising:

a primary vacuum pump comprising an inlet opening, an outlet opening, a compression mechanism including a compression stage comprising discrete pockets of compression that are sealed from each other and are interposed between the inlet opening and the outlet opening, and an intermediate gas passageway comprising a first end and a second end, and a secondary vacuum pump comprising an inlet at which the secondary vacuum pump is connected to the primary vacuum pump at the first end, and wherein the primary vacuum pump is an oil-free positive displacement pump, the pockets comprise an inlet pocket at which fluid is taken into the compression stage, and an outlet pocket from which fluid is discharged from the compression stage, the second end is directly connected to a gas flow path of the primary vacuum pump that starts at the inlet opening, runs through the compression stage and ends at the outlet opening such that the secondary vacuum pump is operable to draw gas out of the compression stage of the primary vacuum pump at a location upstream of the outlet opening of the primary vacuum pump, and wherein the compression ratio of the primary vacuum pump and the secondary vacuum pump operating in combination is greater than that of the compression ratio of either of the primary vacuum pump and the secondary vacuum pump operating individually.

2. The rough vacuum pump system as claimed in claim 1, further comprising a directional control valve disposed in-line in the intermediate gas passageway and located between the second end and the secondary vacuum pump.

3. The rough vacuum pump system as claimed in claim 2, wherein the directional control valve is a two position directional flow control valve that is movable between a first position at which the directional control valve allows the flow of gas to the secondary vacuum pump from the primary vacuum pump via the intermediate gas passageway, and a second position at which the directional control valve blocks the flow of gas to the secondary vacuum pump from the primary vacuum pump via the intermediate gas passageway, and further comprising a control system operatively connected to the secondary vacuum pump and to the directional control valve and configured to turn the secondary vacuum pump off when the directional control valve is in the second position.

4. The rough vacuum pump system as claimed in claim 2, wherein the directional control valve comprises a first port at which the directional control valve is connected to the intermediate gas passageway, a second port at which the directional control valve is connected to the secondary vacuum pump, and a ballast gas third port, and the directional control valve is movable between a first position at which the directional control valve allows the flow of gas to the secondary vacuum pump from the primary vacuum pump via the intermediate gas passageway while closing fluid communication between the intermediate gas passageway and the third port, and a second position at which the directional control valve allows the flow of gas to the primary vacuum pump via the third port and the intermediate gas passageway while closing fluid communication between the primary vacuum pump and the secondary vacuum pump via the intermediate gas passageway.

5. The rough vacuum pump system as claimed in claim 1, wherein the rough vacuum pump system operates compression to pump a gas whose density is less than that of air.

6. A vacuum apparatus comprising:

a rough vacuum pumping system comprising:

a primary vacuum pump comprising an inlet opening, an outlet opening, a compression mechanism including a compression stage comprising discrete pockets of compression that are sealed from each other and are interposed between the inlet opening and the outlet opening, and an intermediate gas passageway comprising a first end and a second end, and a secondary vacuum pump comprising an inlet at which the secondary vacuum pump is connected to the primary vacuum pump at the first end, and wherein the primary vacuum pump is an oil-free positive displacement pump, the pockets comprise an inlet pocket at which fluid is taken into the compression stage, and an outlet pocket from which fluid is discharged from the compression stage, the second end is directly connected to a gas flow path of the primary vacuum pump that starts at the inlet opening, runs through the compression stage and ends at the outlet opening such that the secondary vacuum pump is operable to draw gas out of the compression stage of the primary vacuum pump at a location upstream of the outlet opening of the primary vacuum pump, and wherein the compression ratio of the primary vacuum pump and the secondary vacuum pump operating in combination is greater than that of the compression ratio of either of the primary vacuum pump and the secondary vacuum pump operating individually, and a tracer gas detector that detects a tracer gas, the tracer gas detector being connected to the primary vacuum pump at an inlet of the primary vacuum pump defining the inlet opening.

7. The vacuum apparatus as claimed in claim 6, wherein the tracer gas detector comprises a component selected from the group consisting of: a mass spectrometer; a Penning cell; a magnetron; and a gas-consuming vacuum gauge.

8. The vacuum apparatus as claimed in claim 6, wherein the rough vacuum pump system operates to pump the tracer gas.

9. A rough vacuum pump system comprising:

a dry vacuum scroll pump comprising an inlet opening, an outlet opening, and an intermediate gas passageway comprising a first end and a second end, the vacuum scroll pump further comprising a stationary scroll blade, an orbiting scroll blade nested with the stationary scroll blade so as to delimit therewith a series of pockets comprising a compression stage of the scroll pump, and an exhaust check valve disposed upstream of the outlet opening; and a secondary vacuum pump comprising an inlet at which the secondary vacuum pump is connected to the vacuum scroll pump at the first end, and wherein the second end is directly connected to a gas flow path of the vacuum scroll pump that starts at the inlet opening, runs through the compression stage and ends at the exhaust check valve such that the secondary vacuum pump is operable to draw gas out of the compression stage of the vacuum scroll pump at a location upstream of the exhaust check valve, and wherein the compression ratio of the vacuum scroll pump and the secondary vacuum pump operating in combination is greater than that of the compression ratio of either of the vacuum scroll pump and the secondary vacuum pump operating individually.

10. A vacuum apparatus comprising:

a rough vacuum pumping system comprising:

a dry vacuum scroll pump comprising an inlet opening, an outlet opening, and an intermediate gas passageway comprising a first end and a second end, the vacuum scroll pump further comprising a stationary scroll blade, an orbiting scroll blade nested with the stationary scroll blade so as to delimit therewith a series of pockets comprising a compression stage of the scroll pump, and an exhaust check valve disposed upstream of the outlet opening; and a secondary vacuum pump comprising an inlet at which the secondary vacuum pump is connected to the vacuum scroll pump at the first end, and wherein the second end is directly connected to a gas flow path of the vacuum scroll pump that starts at the inlet opening, runs through the compression stage and ends at the exhaust check valve such that the secondary vacuum pump is operable to draw gas out of the compression stage of the vacuum scroll pump at a location upstream of the exhaust check valve, and wherein the compression ratio of the vacuum scroll pump and the secondary vacuum pump operating in combination is greater than that of the compression ratio of either of the vacuum scroll pump and the secondary vacuum pump operating individually, and a tracer gas detector that detects a tracer gas, the tracer gas detector being connected to the vacuum scroll pump at an inlet of the vacuum scroll pump defining the inlet opening.

11. The vacuum apparatus as claimed in claim 10, wherein the rough vacuum pump system operates to pump the tracer gas.

12. A rough vacuum pump system comprising:

a dry vacuum scroll pump comprising an inlet opening, an outlet opening, and an intermediate gas passageway comprising a first end and a second end, the vacuum scroll pump further comprising a stationary scroll blade, and an orbiting scroll blade nested with the stationary scroll blade so as to delimit therewith a series of pockets comprising a compression stage of the scroll pump; and a secondary vacuum pump comprising an inlet at which the secondary vacuum pump is connected to the primary vacuum pump at the first end, and wherein the pockets of the vacuum scroll pump comprise an inlet pocket at which fluid is taken into the compression stage, and an outlet pocket from which fluid is discharged from the compression stage, and the second end is directly connected to a gas flow path of the vacuum scroll pump that starts at the inlet opening, runs through the compression stage and ends at the outlet pocket such that the secondary vacuum pump is operable to draw gas out of the compression stage of the primary vacuum pump at a location upstream of the outlet pocket of the vacuum scroll pump.

13. The rough vacuum pump system as claimed in claim 12, further comprising a directional control valve disposed in-line in the intermediate gas passageway and located between the second end and the secondary vacuum pump.

14. The rough vacuum pump system as claimed in claim 13, wherein the directional control valve is a two position directional flow control valve that is movable between a first position at which the directional control valve allows the flow of gas to the secondary vacuum pump from the vacuum scroll pump via the intermediate gas passageway, and a second position at which the directional control valve blocks the flow of gas to the secondary vacuum pump from the vacuum scroll pump via the intermediate gas passageway, and further comprising a control system operatively connected to the secondary vacuum pump and to the directional control valve and configured to turn the secondary vacuum pump off when the directional control valve is in the second position.

15. The rough vacuum pump system as claimed in claim 13, wherein the directional control valve comprises a first port at which the valve is connected to the intermediate gas passageway, a second port at which the directional control valve is connected to the secondary vacuum pump, and a ballast gas third port, and the directional control valve is movable between a first position at which the directional control valve allows the flow of gas to the secondary vacuum pump from the vacuum scroll pump via the intermediate gas passageway while closing fluid communication between the intermediate gas passageway and the third port, and a second position at which the directional control valve allows the flow of gas to the vacuum scroll pump via the third port and the intermediate gas passageway while closing fluid communication between the vacuum scroll pump and the secondary vacuum pump via the intermediate gas passageway.

16. A vacuum apparatus comprising:

a rough vacuum pumping system comprising:

a dry vacuum scroll pump comprising an inlet opening, an outlet opening, and an intermediate gas passageway comprising a first end and a second end, the vacuum scroll pump further comprising a stationary scroll blade, and an orbiting scroll blade nested with the stationary scroll blade so as to delimit therewith a series of pockets comprising a compression stage of the scroll pump; and a secondary vacuum pump comprising an inlet at which the secondary vacuum pump is connected to the primary vacuum pump at the first end, and wherein the pockets of the vacuum scroll pump comprise an inlet pocket at which fluid is taken into the compression stage, and an outlet pocket from which fluid is discharged from the compression stage, and the second end is directly connected to a gas flow path of the vacuum scroll pump that starts at the inlet opening, runs through the compression stage and ends at the outlet pocket such that the secondary vacuum pump is operable to draw gas out of the compression stage of the primary vacuum pump at a location upstream of the outlet pocket of the vacuum scroll pump, and a tracer gas detector that detects a tracer gas, the tracer gas detector being connected to the vacuum scroll pump at an inlet of the vacuum scroll pump that defines the inlet opening.

17. The vacuum apparatus as claimed in claim 16, wherein the compression ratio of the vacuum scroll pump and the secondary vacuum pump operating in combination to pump the tracer gas is greater than that of the compression ratio of either of the vacuum scroll pump and the secondary vacuum pump operating to pump the gas alone.

* * * * *